United States Patent [19]

Hager

[11] 4,087,998

[45] May 9, 1978

[54] CURLING DIE APPARATUS

[75] Inventor: Clarence H. Hager, Rockford, Ill.

[73] Assignee: Modern Suspension Systems, Inc., Rockford, Ill.

[21] Appl. No.: 794,538

[22] Filed: May 6, 1977

[51] Int. Cl.[2] ..... B21D 5/14

[52] U.S. Cl. ..... 72/166; 72/379; 72/133

[58] Field of Search ..... 72/133, 166, 368, 379, 72/369

[56] References Cited

U.S. PATENT DOCUMENTS

| | | | |
|---|---|---|---|
| 708,015 | 9/1902 | Blakey | 72/166 X |
| 2,245,407 | 6/1941 | Lignian | 72/134 |
| 2,413,594 | 12/1946 | White | 72/133 X |
| 2,555,708 | 6/1951 | Scully | 72/166 |

*Primary Examiner*—Leon Gilden
*Attorney, Agent, or Firm*—Morsbach & Pillote

[57] ABSTRACT

A curling die apparatus adapted for use in a press and having a die member with a semi-cylindrical cavity adapted to be mounted on one press member and a sheet engaging means on the other press member for advancing a sheet of material edgewise along a path tangent to the inlet edge of the semi-cylindrical die cavity to progressively deflect the sheet material into a curl. The curling die apparatus includes a movable sheet guide member normally positioned to engage one side of the sheet adjacent the inlet edge of the die cavity to guide the sheet while the lead edge of the sheet moves progressively in a curl along the semi-cylindrical cavity and the guide member is automatically moved to a position away from the die cavity as the lead edge of the sheet exits from the semi-cylindrical die cavity to allow the lead edge of the sheet to continue to curl through at least a major portion of the cylinder. In those applications where it is desired to form a curl on both edges of a sheet of material, a clamp is provided for gripping the curl on one edge of the sheet to prevent deformation of the curl on one edge of the sheet during forming of the curl on the other edge.

22 Claims, 6 Drawing Figures

2
11
25
24
13
28
29
12
35
41
42
46
45
47
10
23
28b
13b
13a
13c
13d
28a
S
29a
29b
21
21a
21b
31
32
34
39
38
35a
16
15
17
X
E

CURLING DIE APPARATUS

BACKGROUND OF THE INVENTION

It has heretofore been proposed, for example as shown in U.S. Pat. No. 2,555,708, to form a cylindrical curl or roll on a sheet of material by forcing the sheet edgewise through a tangent slot in an otherwise closed cylindical die having a core member inside the die. However, with such a closed curling die apparatus, it is necessary to provide a core member extending the length of the curling die and to relatively move the sheet, die and core member in a direction axially of the die in order to separate the curled sheet from the die and core member. Such a closed curling die accordingly was not suitable for forming relatively long curls. It has also been proposed, as shown in U.S. Pat. Nos. 708,015 and 735,936 to use open curling dies having only a semi-cylindrical cavity. However, because of problems encountered in forming the initial portion of the curl using such open semi-cylindrical dies, it was necessary in such prior open curling dies to pre-bend or pre-curl the lead edge of the sheet into at least a portion of a cylinder, before feeding the same into the semi-cylindrical curling die. Such a two step operation for curling the sheet not only increased the amount of handling and time required to form a curl on the sheet but also made it difficult to form a smooth continuous curl free of discontinuities.

SUMMARY OF THE INVENTION

It is the object of the present invention to overcome these disadvantages of the prior art by providing a curling die apparatus which enables curling of a sheet into a major portion of a cylinder in a single operation and in which the curled sheet can be easily removed from the die after forming.

Accordingly, the present invention provides a curling die having a semi-cylindrical die cavity open at one side, sheet engaging means for advancing a sheet of deformable material edgewise in a plane tangent to the semi-cylindrical cavity at one lengthwise edge, and a movable sheet guide mounted for movement relative to the curling die in a direction laterally of the open side of the die cavity between a sheet guide position in which the nose is spaced from one lengthwise edge of the die cavity a distance substantially equal to the thickness of the sheet of material to guidably engage the sheet of material while the lead edge of the sheet moves progressively in a curl along the die cavity, and means responsive to movement of the lead edge of the sheet along the die cavity through a preselected arc for moving the movable sheet guide to a position spaced from the open side of the die cavity to allow the lead edge of the sheet to continue to curl through the major portion of a cylinder. The movable sheet guide is advantageously mounted for swinging movement relative to the curling die and arranged so that it is engaged by the lead edge of the sheet as it exits from the die cavity to be moved by the lead edge of the sheet to a position laterally spaced from the open side of the die to allow the sheet to continue to curl through at least a major portion of the cylinder.

In some applications it is desirable to form a curl on both edges of a sheet of material and the invention also includes a clamp mechanism for gripping the curl on one edge of a sheet of material when feeding the other edge of the sheet into the curling guide to form a curl on the other edge of the sheet of material.

These, together with other objects, features and advantages of the invention will be more readily understood by reference to the following detailed description, when taken in connection with the accompanying drawings wherein.

Figures 1, 2, 3:
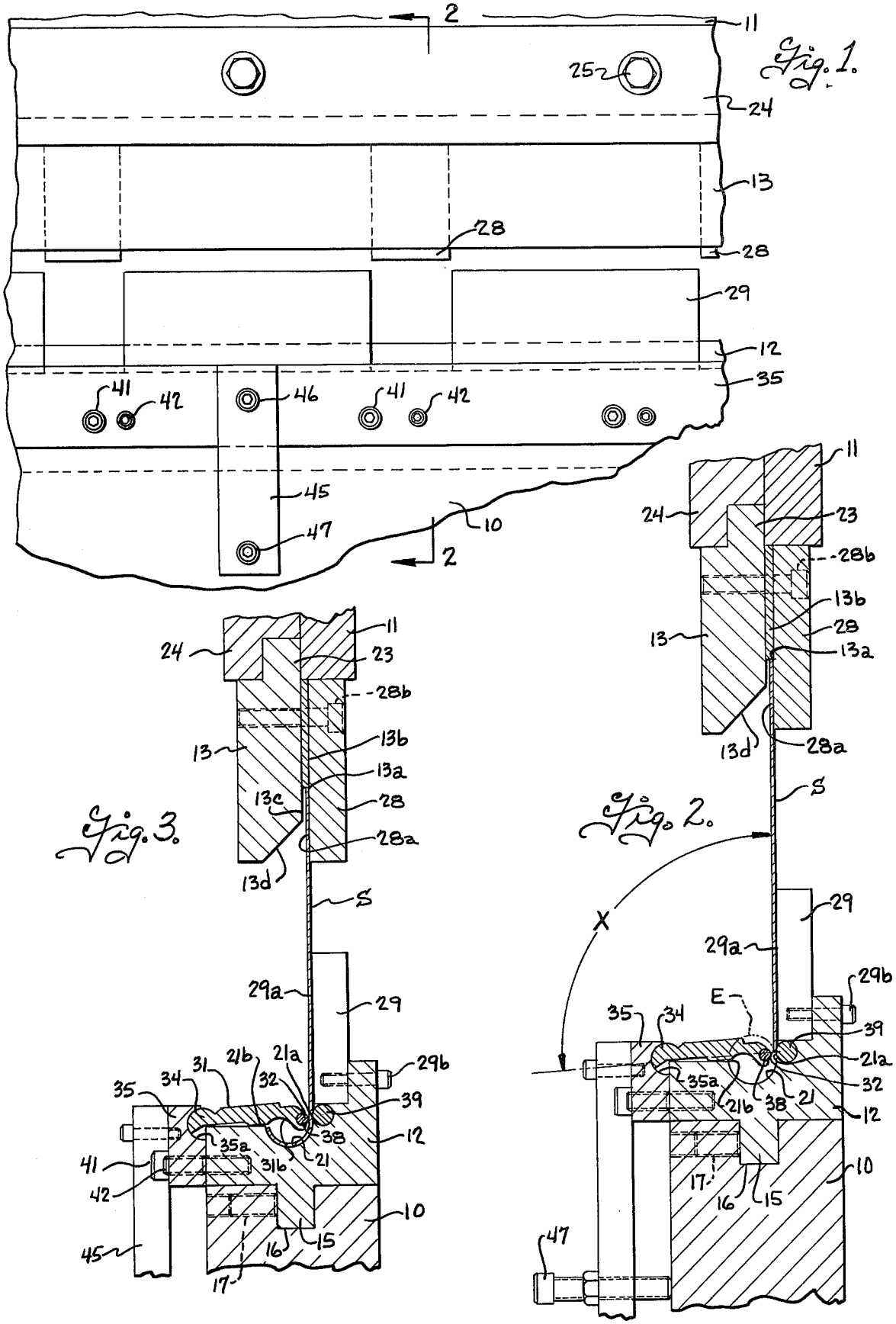
FIG. 1 is a fragmentary front elevational view of a press apparatus having the curling die apparatus of the present invention applied thereto.
FIGS. 2, 3 and 4 are vertical sectional views through the curling die apparatus and illustrating the parts in different moved positions thereof during curling of one edge portion of the sheet to a major portion of a cylinder.

The curling die apparatus of the present invention is adapted for use in a press apparatus having a pair of press members that are relatively movable toward and away from each other along a path. The curling die apparatus may, for example, be used with a conventional press brake having a fixed bolster 10 and a movable ram 11 which is reciprocable along a path toward and away from the bolster. As is conventional, such press brakes have power operated mechanism for reciprocating the ram relative to the bolster under the control of an operator actuated device at a preferably controlled speed and through a stroke which is adjustable by means of stops or limits. The construction and operation of such brakes is old and well known and detailed description of the construction and operation is deemed unnecessary.

The curling die apparatus of the present invention includes a curling die 12 adapted to be mounted on one of the press members such as the bolster 10, and a sheet engaging mechanism 13 adapted to be mounted on the other press member such as the ram 11 for advancing the sheet edgewise along a path paralleling the path of movement of the press members.

The curling die member 12 is clamped or otherwise secured to the bolster 10 and, as shown, is provided with a lengthwise extending tongue 15 that extends into a groove 16 in the bolster and is locked in position as by screws 17. The die member 12 has a lengthwise extending semi-cylindrical cavity 21 that is open at one side and forms a part of a generally cylindrical envelope, designated E in FIG. 2. For reasons pointed out more fully hereinafter, the semi-cylindrical cavity extends through an arc of substantially greater than 90° and not significantly more than 180°. In the preferred embodiment illustrated, the cavity forms a semi-cylinder of 180° having a lengthwise extending inlet edge **21*a* and a lengthwise extending outlet edge 21*b***

The sheet engaging mechanism 13 comprises a rigid jaw member attached to the ram 11 for movement therewith and, as shown, has a tongue 23 that is clamped to the ram as by a clamp bar 24 and clamp screws 25. The sheet engaging jaw member is arranged to advance the sheet S edgewise along a path tangent to the inlet edge **21*a* of the die cavity 21. Sheet guides are provided for guiding the sheet S and, in the embodiment shown, comprises sheet guide members 28 and 29** respectively attached to the sheet engaging jaw member 13 and die member 12 and having sheet engaging faces 28*a* and 29*a* respectively disposed in a plane paralleling the path of movement of the ram and tangent to the inlet edge of the die cavity 21. As best shown in FIG. 1, the sheet guide members 28 and 29 preferably comprise a pluraltiy of separate members which are spaced apart and staggered in a direction lengthwise of the ram and bolster so that the guide members 28 and 29 interfit when the ram is moved toward the bolster. As shown, the sheet guide members 28 are secured to the sheet engaging jaw member 13 by fasteners 28*b* and sheet guide members 29 are secured to the die member 12 by fasteners 29*b*. In the form shown in FIGS. 1–4, the sheet engaging jaw member 13 is arranged to engage the edge of a flat sheet S and is provided with a jaw face 13*a* arranged to engage the upper edge of the sheet S. The jaw face 13*a* is advantageously formed on the lower edge of a pusher plate 13*b* that is intermoved between the jaw member 13 and the sheet guide members 28. The pusher plate has a thickness slightly greater than that of the sheet S and the edge 13*a* is spaced inwardly of the lower edge of the jaw member 13 to provide a sheet receiving cavity 13*c*. Pusher plates of different depth can be used to adjust the depth of the cavity 13*c*, as desired. The lower faces 13*d* of the jaw members are inclined relative to the guide members 28 in a direction to cam the edge of the sheet S toward the guide faces 28*a*. The inclined jaw face facilitates insertion of the sheet into the press apparatus, as described more fully hereinafter.

A movable sheet guide member 31 is provided for engaging the other side of the sheet of material adjacent the inlet edge 21*a* of the die cavity to maintain the sheet in engagement with the die cavity as the lead edge of the sheet moves progressively in a curl along the die cavity and to form a portion of a semi-cylindrical curl on a sheet, and provision is made for moving the movable sheet guide member laterally away from the die cavity as the lead edge of the sheet exists from the die cavity to allow the lead edge of the sheet to continue to curl through at least a major portion of a cylinder. In this manner, a cylindrical curl extending through a major portion or even a complete cylinder can be formed in a single operation. The movable sheet guide member 31 comprises an elongated rigid member having a nose portion 32 and mounted for movement to the die member 12 in a direction laterally of the open side of the die. The movable sheet guide member is advantagously supported for swinging movement relative to the die member about an axis parallel to and offset from the die cavity and the movable sheet guide member has a portion intermediate the nose portion and its pivot axis which extends across the open side of the die cavity at the other lengthwise edge thereof to be engaged by the lead edge of the sheet as it moves out of the die cavity so that the movable sheet guide member is moved by the lead edge of the sheet from its sheet guiding position to an inoperative position. As shown, the movable sheet guide means has a semi-cylindrical hinge portion 34 parallel to and spaced from the nose portion 32 and a hinge member 35 is mounted on the die member 12 and provided with a semi-cylindrical hinge recess 35*a*, for receiving the hinge portion of the movable sheet guide member and to allow pivotal movement of the same in a direction laterally of the open side of the die cavity. When the movable sheet guide member is in its operative or sheet guiding position, the nose portion 32 is disposed as shown in FIGS. 2 and 3 and is located inwardly of the cylindrical envelope E that is contiguous to the die cavity 21, and the nose portion 32 is spaced radially inwardly of the die cavity from the inlet edge 21*a* thereof a distance substantially equal to the thickness of the sheet of material so as to engage the side of the sheet opposite the side that engages the die cavity to maintain the sheet in engagement with the die cavity as the lead edge of the sheet progresses in a curl along the die cavity. In order to reduce friction and wear at this point, the nose portion is advantageously provided with a wear resistant insert, conveniently in the form of a cylindrical rod designated 38, disposed in a semi-cylindrical recess in the movable sheet guide member. Similarly, a wear resistant insert advantageously in the form of a cylindrical rod 39 is provided in the die member 12 at the inlet edge of the die cavity, with the rod 39 disposed in semi-cylindrical recess in the die member 12 outwardly of the die cavity and with the rods 39 tangent to the plane paralleling the guide faces 29*a* at the inlet edge 21*a* of the cavity. The rods 38 and 39 are formed of a wear resistant material such as hardened steel and advantageously comprise a plurality of endwise abutting rod sections.

Figure 4:
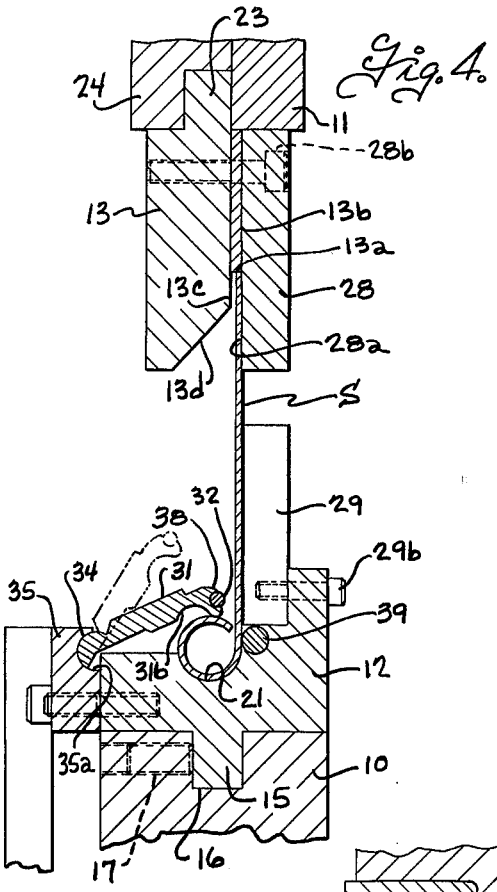

While the lead edge of the sheet moves along the first half of the die cavity, that is through the first 90° of a semi-cylindrical curl, the forces acting between the sheet and die cavity tend to urge the sheet in a direction away from the inlet edge 21*a* and it is necessary to maintain the movable sheet guide member in its sheet guiding position as the lead edge of the sheet moves along the first half of the semi-cylindrical die cavity. However, while the lead edge of the sheet progresses the second half of the die cavity, that is through the second 90° of a semi-cylindrical curl, the die cavity operates to confine the curl and maintain the sheet in engagement with the lead edge of the die cavity. The movable sheet guide member can therefore be moved laterally away from the open side of the die after the lead edge of the sheet has moved through an arc substantially greater than 90° and preferably when it reaches 180° as shown in FIG. 3. At that time, the lead edge of the sheet engages the movable sheet guide member 31 at a location intermediate the nose portion and the pivot axis thereof and moves the movable sheet guide member in a direction laterally away from the open side of the die to a position as shown in FIG. 4 in which the movable sheet guide member is disposed outside the circular envelope contiguous to the die cavity so as to allow the sheet to continue to curl through at least a major portion of a circle. In order to facilitate movement of the movable sheet guide member from its operative to its inoperative position, the pivot axis of the movable sheet guide member is preferably arranged so that a plane through the pivot axis and nose portion, when the second guide member is in its operative guiding position, is transverse to the plane of the guide faces 29*a*, 28*a* and preferably forms an angle indicated at X in FIG. 2 which is slightly greater than 90°. The friction between the nose portion and the sheet as the sheet is advanced into the cavity tends to hold the movable sheet guide member in its operative position and, by making the angle X slightly greater than 90°, the force that must be exerted by the lead edge of the sheet against the movable sheet guide member to move it to its inoperative position, is reduced. The movable sheet guide member is also conveniently formed with a downwardly concave undersurface designated 31*b* that extends from the outlet edge 21*b* of the die cavity forwardly toward the nose portion, to engage and aid in guiding the lead edge of the sheet in a curl. The spacing between the nose portion 32 and the inlet edge 21*a* of the cavity must be substantially equal to the thickness of the sheet being curled and; in order to accommodate sheets of different thickness, provision is made for adjusting the position of the nose portion on the second sheet guide member when the latter is in its sheet guiding position. For this purpose, the hinge member 31 is secured to the die member 12 as by cap screws 41 and set screws 42 are threaded into the hinge member and arranged to engage the face of the die member to allow limited adjustment of the hinge member in a direction laterally of the die member. The cap screws 41 can thereafter be turned to hold the hinge member in its laterally adjusted position. The cap screws 41 and set screws 42 are disposed below the level of the hinge recess 35*a* and, in order to inhibit rocking or tilting of the hinge member under the forces incurred during formation of the curl on the sheet, stabilizer bars 45 are secured to the hinge member as by fasteners 46 and extend below the hinge member and have adjustable abutments such as bolts 47 at their lower ends arranged to engage the bolster 10. As will be seen, the adjustable abutments 47 counteract the lateral forces exerted on the hinge member by the movable sheet guide member 31 and aid in maintaining accurate spacing between the nose portion of the movable sheet guide member and the inlet edge of the die cavity.

When the formation of the curl is completed, the movable sheet guide member rests on the curl as shown in solid lines in FIG. 4. The sheet with the curled edge can then be removed from the curling die apparatus after the ram 11 is raised, by merely lifting the sheet out of the die. The movable sheet guide member swings upwardly from the sodid line shown in FIG. 4 to the position shown in phantom lines to allow the curled edge to clear the movable sheet guide member. Thus, the curling die apparatus not only allows formation of a curl constituting the major portion of a cylinder in a single operation, but also allows easy removal of the curled edge from the die after completion of the durling operation.

Figure 5:
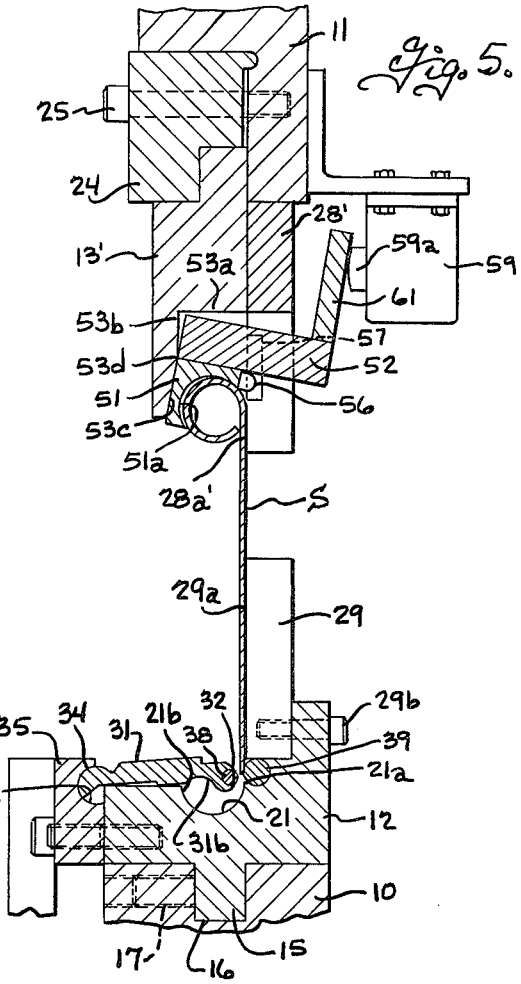
FIGS. 5 and 6 are fragmentary vertical sectional views illustrating a curling die apparatus having a modified sheet engaging mechanism for gripping a curl on one edge of a sheet and illustrating the parts in different moved positions thereof during feeding of the sheet into the curling die to form a curl on the other edge.
Figure 6:
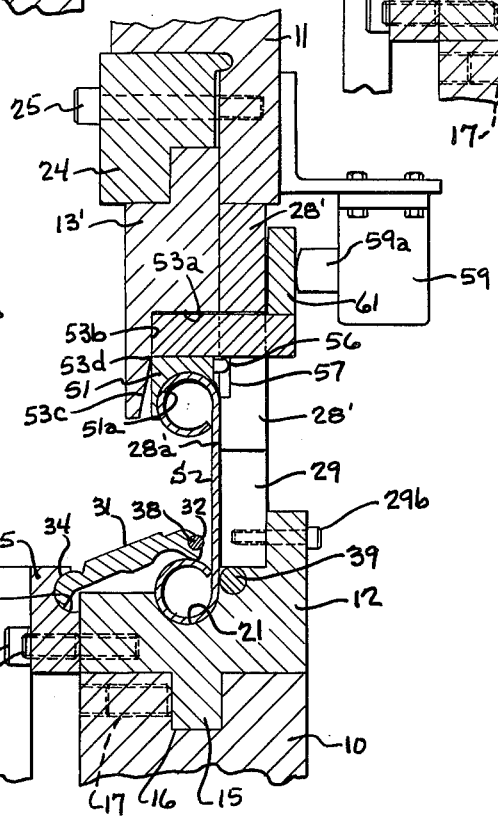

In some applications it is desirable to form a curl on both edges of a sheet of material. In order to prevent distortion of the curl formed on one edge of the sheet, while forming a curl on the other edge, a modified sheet clamp mechanism shown in FIGS. 5 and 6 is provided. The sheet clamp mechanism includes a sheet engaging member 13' secured to the ram 11 by the aforementioned clamp bar 24 and sheet guide members 28' attached to the sheet engaging member. A clamp is provided on the sheet engaging member for engaging the curled edge on a sheet through a major portion of a cylinder and for clamping the same against the guide faces 28*a'* on the sheet guides 28'. The clamps comprise a generally L-shaped member 51 having a semi-cylindrical face 51*a* dimensioned to closely receive the curl formed on one edge of the sheet by the curling die 12. The clamp member is supported for pivotal or rocking movement relative to the sheet engaging member 13' between an open position as shown in FIG. 5 and a clamp position as shown in FIG. 6. The clamp member 51 is secured to a plate 52 and the sheet engaging member 13' is formed with a cavity having a generally horizontal upper wall 53*a*, a generally vertical wall portion 53*b* and a wall portion 53*c* that is inclined downwardly and outwardly from the wall portion 53*b* and defines a fulcrum 53*d* therebetween. As will be seen, the bar 52 and clamp member 51 can pivot or rock on the fulcrum 53*d* in the recesses 53 about an effective axis that is parallel to and offset forwardly from the plane of the sheet S. A stop dog 56 is provided on the clamp member 51 and extends into a recess 57 in the guide members 28', to limit movement of the clamp members out of the recess 53. When the clamp member is in its open position shown in FIG. 5, the cylindrical recess 51*a* is spaced a greater distance from the guide faces 28*a'* to facilitate insertion of the curled edge on the sheet into the clamp. The clamp is then moved to its clamped position as shown in FIG. 6 to clamp the curl edge against the guide faces 28*a'* and inhibit deformation of the curled edge. Since the effective pivot axis of the clamp member is spaced forwardly from the plane of the sheet, it will be seen that the forces exerted on the sheet during a curling operation aid in holding the clamp member in its clamped position. Any suitable means may be provided for moving the clamp member into and out of its clamped position and, as shown, a fluid cylinder 59 is mounted on the ram and has a rod 59*a* that engages an actuating lever 61 on the bar 57. The supply of fluid to the actuator 59 can be selectively controlled as by suitable valves (not shown) operated by the press operator, to enable selective movement of the clamp members between the clamp and release positions. When in their clamp position, the clamp members distribute the forces substantially uniformly around a major portion of the curled edge to minimize deformation of the curl formed on one edge of the sheet while forming the curl on the other edge. The formation of the curl on the other edge of the sheet is otherwise achieved in substantially the same manner as that previously described in connection with FIGS. 1–4.

From the foregoing it is thought that the construction and operation of the curling die apparatus will be readily understood. When forming the curl on edge of a sheet of material, the ram is raised to a position slightly higher than the width of the sheet so that the sheet can be inserted between the sheet engaging members and the inlet edge of the die by first introducing the upper edge of the sheet into the cavity 13*c* between the jaw member 13 and the guide 28, and thereafter moving the lower edge of the sheet forwardly until it engages the guide faces 28*a* and 28*b* with its lower edge positioned adjacent the inlet edge 21*a* of the die cavity. As the ram 11 is lowered to a distance generally corresponding to the peripheral length of the curl to be formed on the sheet, the sheet is initailly guided between the inlet edge 21*a* of the die cavity and the nose portion 32 of the sheet guide member so that the sheet moves in a progessive curl along the die cavity until the lead edge of the sheet reaches the outlet edge of the die cavity. At that time, the lead edge of the sheet engages the sheet engaging member 31 and moves the sheet engaging member to a raised position as shown in FIG. 4 while the lead edge of the sheet continues to curl. Thus, a curl forming the major portion or a complete cylinder can be formed on a sheet in a single operation. The sheet guide member is movable from the position shown in solid lines in FIG. 4 to the phantom line position to enable easy removal of the sheet and curled edge from the curling die. If it is desired to form a curled edge on both edges of the sheet, the sheet engaging mechanism of FIGS. 5 and 6 can be used to grip the curl on one edge of the sheet while forming the curl on the other edge.

While particular embodiments of the invention have been shown and discribed, modificaions may be made, and it is intended in the appended claims to cover all such modifications as may fall within the true spirit and scope of the invention.

The embodiments of the invention in which an exclusive property or privilege is claimed are defined as follows:

1. An apparatus for forming a curled edge constituting at least a major portion of a cylinder on a sheet of deformable material comprising: a curling die having an elongaged semi-cylindrical cavity open at one side and having lengthwise extending inlet and outlet edges, means for advancing a sheet of deformable material edgewise along a path with one side of the sheet tangent to said semi-cylindrical cavity at the inlet edge thereof, a sheet guide member having a nose portion paralleling said semi-cylindrical cavity, means mounting the sheet guide member for movement relative to the curling die in a direction laterally of the die cavity between a sheet guiding position in which the nose portion is spaced radially inwardly from the inlet edge of the die cavity and a moved position in which the guide member is spaced from the open side of the die cavity, said movable sheet guide member in said sheet guiding position thereof having its nose portion spaced from said inlet edge of the die cavity a distance substantially equal to the thickness of the sheet of material to guidably engage the other side of the sheet of material as it is advanced along said path whereby to maintain the sheet in engagement with said semi-cylindrical die cavity at said inlet edge thereof while the lead edge of the sheet moves progressively in a curl along the semi-cylindrical die cavity toward the outlet edge thereof, and means responsive to movement of the lead edge of the sheet along said semi-cylindrical cavity through a preselected arc substantially greater than 90° and less than the arc corresponding to said major portion of a cylinder for moving said sheet guide member from its sheet guiding position to said moved position whereby to allow the lead edge of the sheet to continue to curl through said major portion of a cylinder.

2. An apparatus for forming a curled edge according to claim 1 wherein said sheet guide member is supported for swinging movement relative to the curling die in a direction toward and from the open side of the die cavity.

3. An apparatus for forming a curled edge according to claim 1 wherein said sheet guide member is supported for pivotal movement relative to the curling die about an axis parallel to the axis of said semi-cylindrical die cavity and offset in a plane transverse to said path of advance of the sheet from said outlet edge of the cavity.

4. An apparatus for forming a curled edge according to claim 3 including means for adjusting the pivot axis of said sheet guide member in a direction transverse to the path of advance of the sheet to accommodate sheets of different thickness.

5. An apparatus for forming a curled edge according to claim 1 wherein said last mentioned means includes a portion on said sheet guide member extending across the open side of the die cavity at the other lengthwise edge thereof at a location to be engaged by the lead edge of the sheet as it exits from the die cavity.

6. An apparatus for forming a curled edge according to claim 1 wherein said sheet guide member is supported for pivotal movement relative to the curling die about an axis parallel to and offset from the outlet edge of the die cavity in plane traverse to said path; said sheet guide member having a portion extending across the open side of the die cavity at the outlet edge thereof at a location to be engaged by the lead edge of the sheet as it exits from the die cavity to be moved thereby from said sheet guiding position to said moved position.

7. An apparatus for forming a curled edge according to claim 1 wherein said means for advancing the sheet of material edgewise along a path includes sheet guide means paralleling said path to engage one side of the sheet, and a clamp means for clamping the sheet against said sheet guide means.

8. An apparatus for forming a curled edge according to claim 7 wherein said clamp means has a jaw face shaped complementary to a substantial portion of the curled edge formed by the curling die to enable curling of both edges of a sheet of material.

9. A curling die apparatus for use in a press having a pair of press members relatively movable along a path toward and away from each other to curl a portion of a sheet of deformable material into a major portion of a cylinder, said curling die apparatus including an elongated curling die adapted to be mounted on one of the press members and having an elongated semi-cylindrical die cavity open at one side and having lengthwise extending inlet and outlet edges, means adapted to be mounted on the other press member for engaging the sheet of material to advance the sheet edgewise along said path, a first sheet guide means disposed in a plane paralleling said path and tangent to said semi-cylindrical cavity at inlet edge thereof for guidably engaging one side of a sheet of material, a movable sheet guide member having a nose portion paralleling said semi-cylindrical cavity, means mounting said movable sheet guide member for movement relative to the curling die in a direction laterally of the open side of the die cavity between a sheet guiding position in which the nose portion is spaced radially inwardly from the inlet edge of the die cavity and a moved position in which the movable sheet guide member is spaced from the die cavity, said movable sheet guide member in said sheet guiding position thereof having its nose portion spaced from said inlet edge of the die cavity a distance substantially equal to the thickness of the sheet of material to guidably engage the other side of the sheet of material as it is advanced along said path whereby to maintain the sheet in engagement with said die cavity at said inlet edge thereof while the lead edge of the sheet moves progressively in a curl along the die cavity toward the outlet edge thereof, and means operative as the lead edge of the sheet exits from said die cavity for moving the sheet guide member from its sheet guiding position to a moved position to allow the lead edge of the sheet to continue to curl through said major portion of a cylinder.

10. A curling die apparatus according to claim 9 wherein said movable sheet guide member is supported for swinging movement relative to the curling die in a direction toward and away from the open side of the die cavity.

11. A curling die apparatus according to claim 9 wherein said movable sheet guide member is supported for pivotal movement relative to the curling die about an axis parallel to the axis of the semi-cylindrical cavity and offset in a plane transverse to said path from said outlet edge of the die cavity.

12. A curling die apparatus according to claim 9 wherein said movable sheet guide member comprises an elongated rigid member having said nose portion along one lengthwise edge and a semi-cylindrical hinge portion paralleling said nose portion, means on said curling die defining a semi-cylindrical hinge recess paralleling said die cavity and receiving said semi-cylindrical hinge portion to support the movable sheet guide member for pivotal movement relative to the die cavity.

13. A curling die apparatus according to claim 12 wherein the axis of said semi-cylindrical hinge recess is disposed in a plane transverse to said path and offset from the outlet edge of the die cavity.

14. A curling die apparatus according to claim 13 wherein said hinge recess is formed in a hinge member separate from said die member, and means adjustably mounting said hinge member on said die member for adjustment a direction perpendicular to said path relative to the die cavity.

15. A curling die apparatus according to claim 9 wherein said nose portion includes cylindrical rods mounted in semi-cylindrical recesses in the second guide means.

16. A curling die apparatus according to claim 9 wherein said die member has a semi-cylindrical recess along said one lengthwise edge of the die cavity and outside said die cavity, and cylindrical rods disposed in said semi-cylindrical recess and disposed tangent to said path to engage said one side of the sheet of material.

17. A curling die apparatus according to claim 16 wherein said nose portion includes cylindrical rods mounted in semi-cylindrical recesses in the second guide means.

18. A curling die apparatus according to claim 9 wherein said last mentioned means includes a portion on said second sheet guide means extending across the open side of the die cavity at said outlet edge thereof at a location to be engaged by the lead edge of the sheet as it moves out of the die cavity.

19. A curling die apparatus according to claim 9 wherein said movable sheet guide member is supported for pivotal movement relative to the curling die apparatus about an axis parallel to and offset from the die cavity in a plane transverse to said path, said movable sheet guide member having a portion intermediate said nose portion and its pivot axis which extends across the open side of the die cavity at the outlet edge thereof at a location to be engaged by the lead edge of the sheet as it exits from the die cavity.

20. A curling die apparatus according to claim 9 wherein said means mounted on said other press member for advancing the sheet edgewise along said path includes sheet guide means having face portions paralleling said path to engage one side of the sheet, and clamp means for clamping the sheet against the sheet support means.

21. A curling die apparatus according to claim 20 wherein said clamp means has a semi-cylindrical jaw face of a radius corresponding to the radius of the die cavity to clamp the curled edge formed on one edge of the sheet of material while forming a curl on the other edge of the sheet of material.

22. A curling die apparatus according to claim 21 wherein said clamp means is supported for pivotal movement about an axis parallel to and offset from said face portions of said sheet support means.

* * * * *